US008444818B2

(12) United States Patent
Sutman et al.

(10) Patent No.: US 8,444,818 B2
(45) Date of Patent: May 21, 2013

(54) STABLE AND AQUEOUS COMPOSITIONS OF POLYVINYLAMINES WITH CATIONIC STARCH, AND UTILITY FOR PAPERMAKING

(75) Inventors: Frank J. Sutman, Wilmington, DE (US); Christopher P. Dilkus, Woodlyne, NJ (US); Qu-Ming Gu, Bear, DE (US)

(73) Assignee: Hercules Incorporated, Wilmington, DE (US)

( * ) Notice: Subject to any disclaimer, the term of this patent is extended or adjusted under 35 U.S.C. 154(b) by 81 days.

(21) Appl. No.: 13/081,763

(22) Filed: Apr. 7, 2011

(65) Prior Publication Data

US 2011/0247775 A1 Oct. 13, 2011

Related U.S. Application Data

(60) Provisional application No. 61/321,639, filed on Apr. 7, 2010.

(51) Int. Cl.

| | |
|---|---|
| ***D21H 17/28*** | (2006.01) |
| ***D21H 17/45*** | (2006.01) |
| ***D21H 21/02*** | (2006.01) |
| ***D21H 21/10*** | (2006.01) |
| ***D21H 21/18*** | (2006.01) |
| ***C08L 3/04*** | (2006.01) |

(52) U.S. Cl.
USPC ..... 162/168.2; 162/158; 162/164.1; 162/164.6; 162/168.1; 162/175; 162/185; 524/47

(58) Field of Classification Search
USPC ..... 162/158, 164.1, 164.6, 168.1, 168.2, 162/175, 185; 524/47
See application file for complete search history.

(56) References Cited

U.S. PATENT DOCUMENTS

| | | | | |
|---|---|---|---|---|
| 3,556,932 | A * | 1/1971 | Coscia et al. | 162/166 |
| 4,940,514 | A | 7/1990 | Stange et al. | |
| 6,083,348 | A * | 7/2000 | Auhorn et al. | 162/183 |
| 6,616,807 | B1 | 9/2003 | Dyllick-Brenzinger et al. | |
| 6,746,542 | B1 * | 6/2004 | Lorencak et al. | 127/32 |
| 6,911,483 | B2 * | 6/2005 | Ayers et al. | 521/30 |
| 7,074,845 | B2 | 7/2006 | Laleg | |
| 7,090,745 | B2 | 8/2006 | Beckman et al. | |
| 2003/0192664 | A1 * | 10/2003 | Kulick et al. | 162/164.1 |
| 2004/0112559 | A1 | 6/2004 | Du Bourg et al. | |
| 2005/0022956 | A1 | 2/2005 | Rodriguez et al. | |
| 2005/0109476 | A1 | 5/2005 | Jan-Peter et al. | |
| 2006/0037512 | A1 * | 2/2006 | Pawlowska et al. | 106/16 |
| 2007/0004829 | A1 * | 1/2007 | Khabbaz | 524/47 |
| 2008/0041546 | A1 * | 2/2008 | Schmid et al. | 162/164.6 |

FOREIGN PATENT DOCUMENTS

DE 19713755 A1 * 10/1998

OTHER PUBLICATIONS

Smook, Gary A., Handbook of Pulp and Paper Terminology, Angus Wilde Publications, 1990, pp. 220-227.*

* cited by examiner

*Primary Examiner* — Mark Halpern
*Assistant Examiner* — Dennis Cordray
(74) *Attorney, Agent, or Firm* — Michael J. Herman; Joanne Rossi; Shaorong Chen

(57) ABSTRACT

A stable aqueous composition comprising polyvinylamine and liquid cationic starch in a ratio of from 90 to 55 parts of polyvinylamine on active basis to 10 to 45 parts of liquid cationic starch on active basis is disclosed. The composition can be used in papermaking as a strength or as a drainage aid.

21 Claims, No Drawings

STABLE AND AQUEOUS COMPOSITIONS OF POLYVINYLAMINES WITH CATIONIC STARCH, AND UTILITY FOR PAPERMAKING

This application claims the benefit of U.S. provisional application No. 61/321,639, filed Apr. 7, 2010, the entire contents of which are hereby incorporated by reference.

FIELD OF THE INVENTION

This invention relates to the composition of polyvinylamine and liquid cationic starch for use as a dry strength product for paperboard and other paper products. Furthermore, this invention relates to an improved process of making paperboard using the composition.

BACKGROUND OF THE INVENTION

Aqueous solutions of partially and fully hydrolyzed polyvinylamines have great utility in improving paper dry strength, retention and drainage, contaminant control, and application efficiency with other additives, i.e. —starch, sizing, and defoamer. These positive effects are most noticeable in recycled containerboard grades, but can generally be observed in all paper and board grades. Polyvinylamines are highly effective for these purposes, and are enjoying extensive commercial use. However, polyvinylamine chemistry is quite expensive to produce. A greener product is desired which will retain the same functionality of a polyvinylamine homopolymer but that can be manufactured at a lower cost with lower environmental impact.

Polyvinylamines are typically made by solution free-radical polymerization of N-vinylformamide monomer followed by base hydrolysis. The products are usually in a aqueous form at an active polymer solids of about 10-20% by dry weight. Polyvinylamine is highly cationic in solution due to its high density of primary amine or amidine functionality. In general, a polyvinylamine product is used as a single component for papermaking at the wed end.

U.S. Pat. No. 4,940,514 discloses utility of a blend of enzymatically digested starch and polyvinylamine, poly-DADMAC, or poly-vinylimidazoline as a paper strength agent. The claims require the starch to be enzymatically reduced and to be within a specified solution viscosity. They also specify that the ratio of cationic polymer to starch be 1 to 20 parts polymer to 100 parts starch. US patent application 20040112559 discloses blends of low viscosity starch and synthetic polymers such as polyacrylamides and polyvinylamines. The starches used are all enzymatically degraded and have low viscosity. There are no synergetic effects in those blends.

US patent application 20050109476 discloses utility of increasing starch adsorption in paper by co-extruding starch with polyvinylamine. The mixture has to be passed through an extruder. U.S. Pat. No. 6,616,807 teaches reacting polyvinylamines with starch. The reaction requires the addition of the polyvinylamine to the starch above its gelatinization temperature. It also claims polyvinylamines as starch retention aids. In this latter case a separate addition to papermaking stock is employed.

U.S. Pat. No. 7,074,845 discloses blends of swollen, unruptured starch granules, anionic latexes, and optionally anionic or cationic co-additives including polyvinylamine or poly-DADMAC. Carboxylmethyl cellulose (CMC) appears preferred as a co-additive from the examples. In this case, the starch is not completely cooked, and anionic latex must also be present in order to practice the invention. U.S. Pat. No. 6,746,542 teaches that prior art reacting polyvinylamines with starch improved paper strength, but resulted in unacceptable reductions in production rate. The improvement is a two-component addition of polyvinylamine or other low molecular weight "cationizer" and a "drainage aid" to the starch, again above the gelatinization temperature. The drainage aid is selected from several cationic or nonionic polymers of greater than 1 million in molecular weight.

A number of prior art references were cited in U.S. Pat. No. 6,746,542. They teach addition and reaction of a synthetic polymeric component to starch. All require the addition by "heating", "digesting" or "reacting under alkaline conditions" to gelatinize the starch. None teach a simple, stable aqueous blend of a high solids and high viscosity starch solution and polyvinylamine that can be formed at ambient temperature and neutral pH.

U.S. Pat. No. 7,090,745 teaches production of hydrogels by reaction of polyvinylamines with reducing sugars. The scope of 7,090,745 includes polymeric sugars such as starch and cellulose, although all of the examples use monomeric sugars. The hydrogels are useful as paper strength agents. The hydrogels are created by blending polyvinylamine and a reducing sugar at room temperature, then heating and mixing the blend for a period of time. The hydrogels are water insoluble materials and not dispersible in water.

US patent application 20050022956 teaches an improved surface sizing composition including a sizing agent (typically starch), a cationic polymer including polyvinylamine, and an anionic polymer such as SMA. The anionic polymer must be present to practice the claimed invention.

There remains a need to develop a lower cost, more environmentally friendly, polyvinylamine based dry strength product for papermaking application. The product must be equivalent or better than polyvinylamine on weight active basis as a dry strength resin and a drainage aid for recycled linerboard and other paper products. The inventors have surprisingly found that the compositions of polyvinylamine with liquid cationic starches at a certain ratios of polyvinylamine to starch show a synergistic effect in papermaking applications and exhibit improved dry strength and drainage properties compared to polyvinylamine alone on the same weight active basis. It reduces the cost-in-use by about 20%. The blend is stable and does not suffer from starch retrogradation in storage.

BRIEF DESCRIPTION OF THE INVENTION

The present invention provides for a composition comprising an aqueous blend of polyvinylamine in conjunction with a high solids and high viscosity liquid cationic starch. The composition can be used as a dry strength additive resulting in paperboard products that show significantly improved dry strength performance. The blends can also be used to provide improved drainage for the recycled fiber pulp and increased machine productivity. Treatment with the inventive blend reduces total cost of the material. Additionally there is less wet strength development than polyvinylamines used alone. Products with less wet strength can be more easily re-pulped.

The blended composition of the liquid cationic starch and polyvinylamine according to present invention contains a ratio of 10 to 45 weight % of a liquid cationic starch to 55 to 90 weight % of a polyvinylamine product on an active polymer basis. A preferred blend contains a ratio of from about 15 to 40 weight % of the liquid cationic starch on active starch basis to 60 to 85 weight % of a polyvinylamine on active polymer basis. The most preferred blend contains a ratio of 20-30 weight % of the liquid cationic starch on active starch basis to 70 to 80 weight % of a polyvinylamine on active polymer basis. The blended compositions exhibit synergistic effect in papermaking and provide improved properties.

The preferable polyvinylamine homopolymers are Hercobond® 6363 (Hercules Incorporated, Wilmington, Del., USA), a fully hydrolyzed product from polyvinylformamide, and Hercobond® 6350 (Hercules Incorporated, Wilmington, Del., USA), a 50% hydrolyzed product from polyvinylformamide. Those products are currently used in papermaking industries for paper dry and wet strength improvement, retention and drainage, deposit control of detrimental substances via fixation, coating color additives for OBA promotion, and rheology modifiers for water retention.

In one embodiment of the invention, the aqueous polymer solutions of polyvinylamines used have active polymer in the range of from 5 to 30% by weight, preferably in the range from 10 to 15% by weight.

Liquid cationic starches are used in this present invention. The cationic starches used in the present invention are not enzymatically hydrolyzed. Those liquid cationic starches are generally used in as papermaking additives for a variety of application including paper strength improvement, fiber substitution, lowering basis weight and reducing refining by providing better drainage and drying. Examples of cationic starches are Redibond® 5000 series liquid cationic starches from National Starch (National Starch, Bridgewater, N.J., USA), Stalok® 280 from AE Staley (Tate & Lyle PLC, London, UK), Vector® SC20157 from Roquette (Roquette, Lestrem Cedex, France), and DynaSol® 300 series cationic starch products (International Additive Concepts Inc., Charlotte, N.C., USA).

In one aspect of the invention the cationic portion of liquid starch products are generally from 3-chloro-2-hydroxypropyltrimethylammonium chloride via chemical modification and the nitrogen content of the liquid cationic starch products can vary from 0.1% to 2.0%. The cationic starch may be further inhibited by treating a chemical crosslinking reagent such as epichlorohydrin.

Preferably the liquid starches have high solids up to 30% and are stable in storage at alkaline and acidic pH.

Preferably the solids content of the liquid starches is in the range of from 10 to 40%, and more preferably from 15 to 35% and most preferably from 20 to 30%. Solids content of the liquid starches is equal to the starch active in weight percentage.

Preferably the viscosity of the liquid starches is in the range of from 1000 to 30,000 cps, and preferably from 2000 to 20000 cps, more preferably from 2000 to 15000 cps and most preferably from 3000 to 12000 cps.

While use of cationic starches as inexpensive dry strength additives is known in papermaking industry, those liquid cationic starch products are not effective in improving both drainage and retention of the fiber onto paper products. The starch products are not effective compared to polyvinylamine products, e.g., Hercobond® 6363 and Hercobond® 6350, in improving drainage of recycled pulps. The blended compositions of the liquid cationic starches and the polyvinylamine at an appropriate blending ratio demonstrated synergistic effects and provided improved dry strength property to recycled linerboard products. The blended compositions also had shown improved retention and drainage effectiveness relative to Hercobond® 6363 and Hercobond® 6350 on the same active basis. Since the costs of liquid cationic starches are much lower than the polyvinylamine products, the blended product described in this invention has the advantage of economic benefits in terms of cost-in-use. In addition starch is a green alternative in that it comes from a renewable source.

DETAILED DESCRIPTION OF THE INVENTION

The invention provides for a stable aqueous composition comprising polyvinylamine and liquid cationic starch in a ratio of from 90 to 55 parts of polyvinylamine on an active basis to 10 to 45 parts of liquid cationic starch on an active basis, wherein the combined active parts of liquid cationic starch and polyvinylamine comprise at least 40 weight % of the total solids of the composition.

In one embodiment of the invention the combined active parts of liquid cationic starch and polyvinylamine comprise between 40 and 90 weight % of the total solids of the composition.

The blended composition of the liquid cationic starch and polyvinylamine according to present invention can contain a ratio of 10 to 45 weight % of a liquid cationic starch on an active starch basis to 55 to 90 weight % of a polyvinylamine product on an active polymer basis. A preferred blend can contain a ratio of from about 20 to 40 weight % of the liquid cationic starch on active starch basis to 60 to 80 weight % of a polyvinylamine on active polymer basis. Another preferred blend can contain a ratio of from about 20 to 35 weight % of the liquid cationic starch on active starch basis to 65 to 80 weight % of a polyvinylamine on active polymer basis. The most preferred blend contains a ratio of 20-30 weight % of the liquid cationic starch on active starch basis to 70 to 80 weight % of a polyvinylamine on active polymer basis.

The polyvinylamine used in the present invention is preferably selected from the group consisting of vinylamine homopolymer (i.e., polyvinylamine), fully or partially hydrolyzed from polyvinylformamide, vinylamine copolymers, vinylamine terpolymers, vinylamine homo- and copolymers manufactured by the Hofmann modification of acrylamide polymers or vinylamine-containing polymers chemically modified after polymerization. The full hydrolyzed polyvinylformamide homopolymer used in the blend of the present invention is a preferred polyvinylamine. It is envisioned that vinylamine copolymers can be used in the invention creating useful stable compositions with the liquid starch. The preferred polyvinylamines used in the present invention are the polyvinylamine homopolymers, Hercobond® 6363 (Hercules Incorporated, Wilmington, Del., USA), a fully hydrolyzed product from polyvinylformamide and Hercobond® 6350 (Hercules Incorporated, Wilmington, Del., USA), a 50% hydrolyzed product from polyvinylformamide.

Liquid cationic starches used in the invention are preferably prepared from waxy maize starch.

In some embodiments of the invention, liquid cationic starches used are preferably prepared from waxy maize starch via cationic modification using 3-chloro-2-hydroxypropyltrimethylammonium chloride and the nitrogen content of the products vary from 0.1% to 2.5% or preferably from 0.1% to 2.0%. The preferred starch products have 20-30% solids with high viscosity and are stable in storage at alkaline and acidic pH in storage. Examples include, but are not limited to, Redibond® 5000 series (National Starch, Bridgewater, N.J., USA), Stalok® 280 (Tate & Lyle PLC, London, UK), Vector® SC20157 (Roquette, Lestrem Cedex, France), and DynaSol® 300 (International Additive Concepts Inc., Charlotte, N.C., USA). The applicable starch bases which may be used in preparing the liquid cationic starch may be derived from other plant sources with high amylopectin content and very low amylose content. Enzymatically hydrolyzed starches are not used in the present invention.

The nitrogen content that is in the cationic starch suitable for use in the invention is in the range from about 0.01 to 2.5%, and preferably from 0.01 to 2.0%, preferably from 0.1 to 1.8%, and most preferably 0.2-1.0%.

In one aspect of the invention the composition comprises a vinylamine polymer selected from the group consisting of vinylamine homopolymer, fully or partially hydrolyzed polyvinylformamide, and a liquid cationic starch derived from waxy maize.

Preferably the solids content of the liquid starches is in the range of from 10 to 40%, and more preferably from 15 to 35% and most preferably from 20 to 30%. Solids content of the liquid starches is equal to the active starch content in weight percentage.

Preferably the viscosity of the liquid starches is in the range of from 1,000 to 30,000 cps, and preferably from 2,000 to 20,000 cps, more preferably from 2,000 to 15,000 cps and most preferably from 3,000 to 12,000 cps.

The polyvinylamine of use in the invention preferably has a molecular weight in the range from 1,000 to 2,500,000, more preferably from 3,000 to 2,000,000, most preferably from 5,000 to 500,000.

The preferable active starch is in the range of 10-50 weight % based on the total actives in the starch-polyvinylamine blended compositions, more preferably in the range of 15-35 weight % and most preferably in the range of 20-30% based on the total actives in the starch-polyvinylamine blended compositions. It is preferred that there is less than or equal to 35 weight % of starch active in the blend (based on the total actives in the starch-polyvinylamine blended compositions), more preferably less than or equal to 30 weight % of starch active in the blend.

The combined weight of actives of starch and polyvinylamine in the composition comprises at least 40% of the total solids of the composition, preferably at least 50% and preferably at least 60%. The total combined actives of starch and polyvinylamine is generally less than 90% and can be from 40 to 90% or from 50-70% of the total solids of the composition.

The aqueous liquid cationic starch/polyvinylamine blend may be produced by mixing a liquid cationic starch with a polyvinylamine solution product at a concentration and at a polyvinylamine/starch ratio. The actual formation of the liquid cationic starch/polyvinylamine composition blend described herein involves mixing the aqueous components together and optionally combining with additional water resulting in a final concentration of about 5.0 to 30.0 weight %, preferably 10 to 18 weight %, most preferably 12 to 15 weight % actives.

Blending of the liquid cationic starch products with polyvinylamine is usually performed by slowly adding starch products into the polyvinylamine solution. The blend can also be prepared by adding the polyvinylamine solution to the liquid cationic starch under the similar conditions, or prepared using an online mixer via a continuous process.

The preferable temperature for the blending process is in the range of 10-70° C., more preferably in the range of 23-60° C. and most preferably in the range of 30-50° C. The blend is then adjusted to a suitable pH using an acid or an alkali. A suitable pH condition of the blended composition can prevent undesired decomposition of the starch material. At low pH, the starch molecule may undergo hydrolysis, while a high pH condition of the blend may result in a chemical decomposition in storage. For example, the decomposition of a hydroxypropyl trimethylammonium group that is appended on a starch molecule can occur under adverse pH conditions. A buffer could used to prevent acid hydrolysis of the starch. For this reason, the pH of the blend is preferably in the range of 3 to 11, more preferably in the range of 5-9, most preferably in the range of 6-8. In the blending process, the materials are generally mixed for 5 to 30 minutes after pH adjustment until the blend becomes homogenous. Longer mixing times can be used.

The blended compositions exhibited good stability in storage with no significant physical changes at 23° C. for 3 months and at 40° C. or 50° C. for 30 days meaning there was little change in viscosity (less than 20% change) and no visible phase separation. The ratio of polyvinylamine to liquid cationic starch in the blends has little effect on the viscosity stability. The preferred viscosity of the blend is in the range of 500 to 4000 cps at 25° C.

The viscosity of a blended composition of about 30 weight % actives of the liquid cationic starch and about 70 weight % actives of Hercobond® 6363 is in the range of from 500 to 4000 cps at 25° C., varying with sources of the starch products from different suppliers. The blended compositions are freezing-thaw stable going through three cycles of temperature changes from 23° C. to −35° C. (35° C. below 0) without phase separation or starch retrogradation.

The compositions of liquid cationic starch and polyvinylamine are normally utilized in the wet end of the paper machine in amounts to provide desired dry strength and drainage properties, the amount on a product active basis ranging from 0.01% to 1 weight % actives based on the weight of dry fiber, preferably ranging from 0.02% to 0.5%, most preferably ranging from 0.05% to 0.3%. Within this range, the precise amount which is used will depend on the type of pulp which is being utilized, the specific operating conditions, as well as the particular end use for which paper is used.

The compositions of this invention can be utilized with 100% recycled fiber in making recycled linerboard as a dry strength additive and drainage aids to improve machine productivity. They can also be utilized for the same purpose with other cellulosic fibers including virgin hardwood or soft wood fibers, bleached and unbleached sulfate (kraft), bleached and unbleached sulfite, bleached and unbleached soda, neutral sulfite semi-chemical, chemi-groundwood, groundwood, and any combination of these fibers, prepared by means of a variety of processes which are used in the papermaking industry.

Without wishing to be bound by theory, it is believed that blending of cationic starch and polyvinylamine creates a physical interaction or complex between the two molecules. The conformation of macromolecules in aqueous solutions is known to affect reactivity with solid substrates and relative performance for intended purposes. The process of blending while in relatively concentrated solution creates a novel colloid which has unique performance properties. This physical interaction is believed to be maintained when the novel composition is mixed with papermaking furnish. Addition of the blended composition results in synergistic dry strength and drainage effects relative to separate addition of the two components to the same furnish.

Another aspect of the present invention is the use of the compositions of cationic starch and polyvinylamine in a variety of papermaking and water treatment beyond dry strength and drainage application. The applications in which the blended compositions of the present invention can be used depend on the type of polyvinylamine used, the level of liquid starch in the composition, as well as the nitrogen content of the cationic starch. For example, compositions made with homopolymers of partially hydrolyzed polyvinylformamide, Hercobond® 6350 and Hercobond® 6330, with high level starch (>40 weight % active starch) could be effective materials in papermaking as pitch and stickies control agents.

The composition of the present invention can be used in combination with other additives in papermaking to improve paper dry strength property and machine productivity. The additives that may be used in combination with the blended composition of the present invention can be a cationic, or an anionic, or an amphoteric, or a nonionic synthetic, or a natural polymer. For example, the polymers of the present invention can be used together with a cationic or amphoteric polyacrylamide product to improve the strength properties of paper products. The composition of the present invention can also be used in combination with an anionic polymer, such as a polyacrylic acid, a copolymer of acrylamide and acrylic acid, or a CMC; a cationic polymer such as a crosslinked polyamidoamine, a polydiallyldimethylammonium chloride, or a polyamine; to form a polyelectrolyte complex to improve the strength properties of paper products. The composition of the present invention can also be used in combination with polymeric aldehyde-functional compounds, such as glyoxalated polyacrylamides, aldehyde celluloses and aldehyde functional polysaccharides.

Inorganic compound such as clay, talc, titanium dioxide, calcium carbonate, pigments, dyes, internal sizing material, rosin and alum and other and calcium sulfate may be added together with the composition of the present invention in the papermaking process to improve papermaking process and quality of paper products. Individual compositions or any combination of different compositions may be applied together with the compositions of the present invention, or may be applied sequentially before or after the application of the polymers of the present invention.

The blended composition may also be used in combination with one or more enzymes to improve paper strength and machine productivity. Such enzymes include hydrolases, such as cellulases, hemicellulases, proteases, beta-glucosidases, lipases, esterases, and pectinases; lyases, such as pectate lyase; and oxidoreductases, such as laccase, glucose oxidase, and peroxidases.

EXAMPLES

Brookfield viscosity (BV) was measured using a DV-E or DV-II Viscometer (Brookfield Viscosity Lab, Middleboro, Mass.). A selected spindle (number 3) was attached to the instrument, which was set for a speed of 30 RPM. The reaction solution is prepared at a specific solid content. The Brookfield viscosity spindle was carefully inserted into the solution so as not to trap any air bubbles and then rotated at the above-mentioned speed for 3 minutes at 24° C. The units are in centipoises (cps).

Active polymer, or active content, or active solids, or active, in the composition of the present invention represents the total weight as a percentage in a solution of all the actives used for making such a composition on dry basis. For example, N-vinylformamide is the monomer precursor for polyvinylamine and has molecular weight of 71.1. Thus, a 100 g polyvinylamine Hercobond® 6363 solution containing a polymer made from 11.7 g of N-vinylformamide has 11.7% active polymer. Active starch content in liquid starch products is the same as the solids content of the liquid starches in weight percentage. A composition of Hercobond® 6363 and RediBond® 5330 (72:28) represents a blended product that contains 72 weight % of Hercobond® 6363 active polymer and 28 weight % active of the liquid cationic starch. As an example, for 100 g of this blended composition with a ratio of 72 wt %:28 wt %, if the total active, or the product active, or the active content, or the active solids, is 10% then the blended composition contains the polyvinylamine polymer made from 7.2 g of vinylformamide and 2.8 g of the cationic starch active.

Example 1

This example illustrates the use of liquid cationic starch and a polyvinylamine in preparing the polyvinylamine-cationic starch composition blends utilized in this invention.

Prequel® 500 (130.7 g, 30%, Hercules Incorporated, Wilmington, Del., USA) was added to polyvinylamine (Hercobond® 6363, 861.5 g, 11.7% active polymer, Hercules Incorporated, Wilmington, Del., USA) in 10 minutes at 24° C. with stirring and then the mixture pH was adjusted to 7.0 using 36% HCl . The resulting formulation was stirred for 10 minutes until the formulation became homogenous. The resulting blend contained 13.8% active solids. Solution viscosity was 1740 cps. The blended formulation was a little cloudy in appearance but homogenous with no separation.

Examples 1-1 through 1-9 in Table I were the blended formulations prepared as described in Example 1 using different liquid cationic starches and/or at different polyvinylamine/starch active ratios. The aqueous liquid cationic starches are National 543690 (National Starch, Bridgewater, N.J.) with nitrogen content at 1.0%, Stalok® 280 (Tate & Lyle PLC, London, UK), RediBond® 5330 (National Starch, Bridgewater, N.J.) with nitrogen content at 0.33%, Vector® SC20157 (Roquette, Lestrem Cedex, France), DynaSol® 308 cationic starch product (International Additive Concepts Inc., Charlotte, N.C., USA) with nitrogen content at 0.3%.

TABLE I

Polyvinylamine-Starch Blends.

| Products | Descriptions | Ratio PVam: Starch | Active Solids | Viscosity (cps) | Appearance |
|---|---|---|---|---|---|
| | RediBond ® 5330 | | 30.0% | 11200 | Cloudy |
| | National ® 543690 | | 21.8% | 7410 | Translucent |
| | Prequel ® 500 | | 30.2% | 6570 | Cloudy |
| | Stalok ® 280 | | 24.1% | 4320 | Cloudy |
| | DynaSol ® 308 | | 30.0% | 5300 | Cloudy |
| | Hercobond ® 6363 | | 11.7% | 720 | Transparent |
| Example 1-1 | Hercobond ® 6363/ Prequel ® 500 | 75/25 | 12.0% | 760 | A little cloudy |
| Example 1-2 | Hercobond ® 6363/ Vector ® SC20157 | 72/25 | 13.0% | 1450 | A little cloudy |
| Example 1-3 | Hercobond ® 6363/ National ® 543690 | 65/35 | 13.8% | 3320 | Translucent |
| Example 1-4 | Hercobond ® 6363/ Stalok ® 280 | 69/31 | 13.5% | 1950 | A little cloudy |
| Example 1-5 | Hercobond ® 6363/ RediBond ® 5330 | 72/28 | 13.8% | 1316 | A little cloudy |
| Example 1-6 | Hercobond ® 6363/ RediBond ® 5330 | 70/30 | 13.4% | 1626 | A little cloudy |
| Example 1-7 | Hercobond ® 6363/ RediBond ® 5330 | 65/35 | 13.6% | 1552 | Cloudy |
| Example 1-8 | Hercobond ® 6363/ RediBond ® 5330 | 50/50 | 15.8% | 3530 | Cloudy |
| Example 1-9 | Hercobond ® 6363/ DynaSol ® 308 | 72/28 | 13.5% | 2010 | A little cloudy |

Example 2

This example illustrates viscosity stability results of the blended composition from Hercobond® 6363 and Redibond® 5330 at 40° C. for one month.

TABLE II

Viscosity Stability of Polyvinylamine/Starch blend

| Products | Weight Ratio of Polyvinylamine/ Starch | Product Active % | Brookfield Viscosity (cps) 0 day | 18 days | 30 days |
|---|---|---|---|---|---|
| Example 1-5 | 72/28 | 13.8 | 1316 | 1068 | 1075 |
| Example 1-6 | 70/30 | 13.4 | 1626 | 1404 | 1405 |
| Example 1-7 | 65/35 | 13.6 | 1552 | 1536 | 1538 |

As shown in Table II, the blended formulations of polyvinylamine-liquid cationic starches are stable at 40° C. for one month with no significant viscosity increase over 30 days. The compositions are homogenous without phase separation at the end of the study. The blended compositions are also freezing-thaw stable without phase separation after three cycle changes in temperature from room temperature to negative 30 C.

Example 3

This example describes various evaluations of the blended compositions as dry strength additives in papermaking applications. In this example, the dry strengths of papers made with the blends of the above examples are compared with the dry strength of paper made with commercial benchmark dry strength polyvinylamine products, Hercobond® 6363 and Hercobond® 6350.

Linerboard paper was made using a papermaking machine. The paper pulp was a 100% recycled medium with 50 ppm hardness, 25 ppm alkalinity, 2.5% GPC® D15F starch (Tate & Lyle PLC, London, UK) and 2000 uS/cm conductivity. The system pH was 7.0 and the pulp freeness was about 380 CSF with the stock temperature at 52° C. The basis weight was 100 lbs per 3000 ft2. Polyvinylamine-starch blends prepared in the above examples were added as dry strength agents to the wet end of the papermaking machine at the level of 0.3 weight % of active polymer versus dry paper pulp. Unless otherwise indicated, Stalok® 300 amphoteric starch (Tate & Lyle PLC, London, UK) and PerForm® PC 8713 flocculant (Hercules Incorporated, Wilmington, Del., USA) were added to the wet end Dry Mullen burst, dry tensile, STFI short span compression, and wet tensile tests were used to measure the dry strength effects.

Table III shows the range of Hercobond® 6363/various liquid cationic starch blended compositions compared to Hercobond® 6363 as a standard. In the Mullen Burst test the higher number indicates better performance.

TABLE III

Dry Strength Performances of Blended Compositions versus Hercobond ® 6363

| Products | Descriptions | Mullen Burst | Dry Tensile | STFI | Wet Tensile |
|---|---|---|---|---|---|
| Hercobond ® 6363 | Commercial benchmark | 100.0 | 100.0 | 100.0 | 100.0 |
| Example 1 | Hercobond ® 6363/ Prequel ® 500 (72/28) | 118.3 | 108.3 | 107.1 | 98.7 |
| Example 1-3 | Hercobond ® 6363/ National ® 543690 (65/35) | 125.6 | 109.5 | 106.0 | 92.5 |
| Example 1-4 | Hercobond ® 6363/ Stalok ® 280 (69/31) | 119.5 | 98.6 | 94.7 | 88.9 |
| Example 1-5 | Hercobond ® 6363/ RediBond ® 5330 (72/28) | 122.9 | 104.4 | 101.3 | 83.5 |

For Table III the data was evaluated using 0.3 weight % of the blended formulation versus dry paper pulp. These data illustrate that the over all performance of polyvinylamine, Hercobond® 6363 can be improved by blending the polymer with starch at certain ratios and conditions. The results suggest synergetic effect of the blends for paper dry strength uses. The addition of low cost cationic starches lowers the overall cost of the blended composition and provides about equal (less than a 6% difference) to increased dry strength effectiveness when compared to Hercobond® 6363 on an equal active basis.

The wet tensile of the recycled linerboard made with the blended formulation was reduced by 10-20% compared to Hercobond® 6363 on an equal active basis. The benefit of this is that the recycled linerboard with lower wet tensile has better re-pulping ability.

Table IV shows dry strength performances of Hercobond® 6363/Prequel® 500 (75/25) blended composition compared to Hercobond® 6363 as a standard at two different dosages. This time, OptiPlus® 1030 amphoteric starch (National Starch, Bridgewater, N.J.) was added in the place of Stalok® 300 cationic starch (Tate & Lyle PLC, London, UK), still used at 0.5% of dry pulp. In the Mullen Burst test the higher number indicates better performance.

TABLE IV

Dry Strength Performances of Blended Compositions versus Hercobond ® 6363

| Products | Descriptions | Total Actives based on dry pulp % | Mullen Burst | Ring Crush | Dry Tensile | Wet Tensile |
|---|---|---|---|---|---|---|
| Hercobond ® 6363 | Commercial benchmark | 0.15 | 100.0 | 100.0 | 100.0 | 100.0 |
| Example 1-1 | Hercobond ® 6363/ Prequel ® 500 (75/25) | 0.15 | 115 | 100 | 105 | 82 |
| Hercobond ® 6363 | Commercial benchmark | 0.30 | 100.0 | 100.0 | 100.0 | 100.0 |
| Example 1-1 | Hercobond ® 6363/ Prequel ® 500 (75/25) | 0.30 | 101 | 104 | 95 | 59 |

These data again demonstrated improved performance of the blended formulation over polyvinylamine, Hercobond® 6363 at two different dosages with reduced wet tensile on an equal active basis.

Table V shows dry strength performances of two Hercobond® 6363/Redibond 5330 compositions compared to Hercobond® 6363 as a standard in making recycled linerboard with the pulp in the absence of Stalok® 300 amphoteric starch (Tate & Lyle PLC, London, UK) and PerForm® PC 8713 flocculant (Ashland Inc.). The data was evaluated using 0.3 weight % of active polymer versus dry paper pulp. In the Mullen Burst test the higher number indicates better performance.

TABLE V

Dry Strength Performances of Blended Compositions versus Hercobond ® 6363 with Pulp Only

| Products | Descriptions | Mullen Burst | STFI | Wet Tensile |
|---|---|---|---|---|
| Hercobond ® 6363 | Commercial benchmark | 100.0 | 100.0 | 100.0 |
| Example 1-6 | Hercobond ® 6363/ RediBond ® 5330 (72/28) | 101.2 | 100.8 | 71.0 |
| Example 1-7 | Hercobond ® 6363/ RediBond ® 5330 (65/35) | 94.9 | 95.3 | 65.4 |

These data shown equivalent or better dry strength performances of the blended compositions at 72/28 polyvinylamine-cationic starch ratio in Mullen Burst and STFI as compared to Hercobond® 6363. At slightly higher level of the liquid cationic starch, both Mullen and STFI reduced less than 6% under the same papermaking conditions. The wet tensile was also reduced with high level of the liquid cationic starch.

Example 4

This example describes the evaluation results of the blended compositions as drainage and retention aids in papermaking applications. Drainage efficiency and retention/fixative properties of the blended compositions in the above examples were compared with Hercobond® 6363 and a blank using the Canadian Standard Freeness (CSF) Test Method and vacuum drainage test (VDT).

For the vacuum drainage test (VDT), the device setup is similar to the Buchner funnel test as described in various filtration reference books, for example see Perry's Chemical Engineers' Handbook, 7th edition, (McGraw-Hill, New York, 1999) pp. 18-78. The VDT consists of a 300-ml magnetic Gelman filter funnel, a 250-ml graduated cylinder, a quick disconnect, a water trap, and a vacuum pump with a vacuum gauge and regulator. The VDT test was conducted by first setting the vacuum to 10 inches Hg, and placing the funnel properly on the cylinder. Next, 250 g of 0.5 wt. % paper stock was charged into a beaker and then the required additives according to treatment program (e.g., starch, vinylamine-containing polymer, flocculants) were added to the stock under the agitation provided by an overhead mixer. The stock was then poured into the filter funnel and the vacuum pump was turned on while simultaneously starting a stopwatch. The drainage efficacy is reported as the time required to obtain 230 mL of filtrate. The results of the two drainage tests were normalized and expressed as a percentage of the drainage performance observed versus a system that did not include the blended compositions.

In Table VI, Hercobond® 6363/Prequel® 500 (75/25) was evaluated for drainage performances by CSF test compared to Hercobond® 6363. The test was conducted at two different dosage based on the dry pulp. The higher percentage CSF freeness relative to the sample of Hercobond® 6363 indicates better performance.

TABLE VI

Drainage evaluation of Polyvinylamine/ Starch blend (75/25) versus Control

| Products | Description | Dose | CSF (%) |
|---|---|---|---|
| Hercobond ® 6363 | Benchmark | 0.15 | 100.0 |
| Example 1-1 | Hercobond ® 6363/ Prequel ® 500 (75/25) | 0.15 | 79 |
| Hercobond ® 6363 | Benchmark | 0.30 | 100.0 |
| Example 1-1 | Hercobond ® 6363/ Prequel ® 500 (75/25) | 0.30 | 110 |

This evaluation shows that the blended composition of Hercobond® 6363/Prequel® 500 (75/25), at 0.30% active resin dosage, provided about 10% additional improvement in drainage performance of the pulp over the improvement of Hercobond® 6363 vs the pulp without additives. At 0.15% active dosage, the blended composition is less effective but similar to Hercobond® 6363 in drainage performance.

Table VII shows VDT vacuum drainage data of a series of Hercobond® 6363/liquid cationic starch compositions evaluated versus Hercobond® 6363 as a standard, using the test as described above. The shorter the drainage time VDT, the better drainage performance. The active dosage is 0.30% for all examples.

TABLE VII

Comparison of Polyvinylamine/Starch Blended Compositions with Control in Drainage Performance of Recycled Fiber

| Products | Descriptions | VDT Time (seconds) | % vs. Hercobond ® 6363 |
|---|---|---|---|
| Blank | None | 50.4 | 257 |
| Hercobond ® 6363 | Commercial benchmark | 19.6 | 100 |
| Example 1 | Hercobond ® 6363/ Prequel ® 500 (72/28) | 19.0 | 97 |
| Example 1-3 | Hercobond ® 6363/ National ® 543690 (65/35) | 18.7 | 95 |
| Example 1-4 | Hercobond ® 6363/ Stalok ® 280 (69/31) | 18.8 | 96 |
| Example 1-5 | Hercobond ® 6363/ RediBond ® 5330 (72/28) | 17.9 | 91 |
| Example 1-8 (comparative) | Hercobond ® 6363/ RediBond ® 5330 (50/50) | 24.7 | 126 |

The VDT data indicates reflect the synergistic effect of the liquid cationic starch products with polyvinylamine in improves drainage of recycled pulps. All the blended compositions drained faster than Hercobond® 6363 except the one with 50% of the starch active in the blend.

Example 5

The turbidities of the filtrates were measured to estimate fixative properties of the blended compositions. The total combined dose of actives of the additives for each example was 0.3%. The evaluations were performed using the filtrates obtained from the VDT test. The turbidity data (FAU value) are summarized in Table VIII and the fixative properties of the compositions are expressed as percentage turbidity of the blank with no chemical treatment. The lower the percentage, the more effective the composition is as a fixative agent.

TABLE VIII

Polyvinylamine/Liquid Cationic Starch Compositions in Reducing Turbidity of Recycled Pulp

| Products | Descriptions | Turbidity (FAU) | % Turbidity of the blank |
|---|---|---|---|
| None | Blank (pulp only) | 73 | 100 |
| Example 1-2 | Hercobond ® 6363/ Vector ® SC20157 (72/25) | 31 | 43 |
| Example 1-3 | Hercobond ® 6363/ National ® 543690 (65/35) | 27 | 37 |
| Example 1-5 | Hercobond ® 6363/ RediBond ® 5330 (72/28) | 26 | 36 |
| Example 1-6 | Hercobond ® 6363/ RediBond ® 5330 (70/30) | 32 | 44 |
| Example 1-7 | Hercobond ® 6363/ RediBond ® 5330 (65/35) | 30 | 41 |
| Example 1-9 | Hercobond ® 6363/ DynaSol ®308 (72/28) | 29 | 49 |

This evaluation demonstrated that the compositions can be used as contaminant control additives in papermaking to control pitch and stickies.

The invention claimed is:

1. A stable aqueous composition comprising polyvinylamine and liquid cationic starch in a ratio of from 90 to 55 parts of polyvinylamine on active basis to 10 to 45 parts of liquid cationic starch on active basis, wherein the combined parts in active of liquid cationic starch and polyvinylamine comprise at least 40 weight % of the total solids of the composition wherein the Brookfield viscosity of the composition is in the range of 500 to 4000 cps using spindle #3 at 30 rpm and 25° C.

2. The composition of claim 1 wherein said the polyvinylamine comprises a vinylamine polymer selected from the group consisting of vinylamine homopolymer, fully or partially hydrolyzed from polyvinylformamide, vinylamine copolymers, vinylamine terpolymers, and vinylamine-containing polymers chemically modified after polymerization.

3. The composition of claim 2 wherein the polyvinylamine comprises fully or partially hydrolyzed polyvinylformamide.

4. The composition of claim 2 wherein the polyvinylamine comprises a vinylamine homopolymer.

5. The composition of claim 1 wherein the liquid starch is a cationic liquid starch derived from waxy maize.

6. The composition of claim 1 wherein the liquid starch is a cationic liquid starch prepared from waxy maize starch which has been cationically modified using 3- chloro-2-hydroxypropyltrimethylammoniurn chloride.

7. The composition of claim 5 wherein the cationic liquid starch has a nitrogen content in the range of from about 0.01 to 2.5%.

8. The composition of claim 5 wherein the solids content of the liquid starch is in the range of from 15 to 35%.

9. The composition of claim 5 wherein the solids content of the liquid starch is in the range of from 20 to 30%.

10. The composition of claim 5 wherein the Brookfield viscosity of the liquid starch having a solids content of from about 10 to 40% is in the range of from 2,000 to 20,000 cps using a number 3 spindle at 30 rpm and 25° C.

11. The composition of claim 1 wherein the polyvinylamine comprises a vinylamine polymer selected from the group consisting of vinylamine homopolymer, fully or partially hydrolyzed polyvinylformamide, and the liquid starch is a liquid cationic starch derived from waxy maize.

12. The composition of claim 1 wherein the polyvinylamine comprises from 60-80 parts of the composition based on actives and liquid cationic starch comprises from 20-40 parts of the composition based on actives.

13. The composition of claim 1 wherein the polyvinylamine comprises from 65-80 parts of the composition based on actives and the liquid cationic starch comprises from 20-35 parts of the composition based on actives.

14. The composition of claim 1 wherein the polyvinylamine comprises from 70-80 parts of the composition based on active and the liquid cationic starch comprises from 20-30 parts of the composition based on active.

15. The composition of claim 1 wherein the combined parts based on actives of liquid cationic starch and polyvinylamine comprise at least 50 weight % of the total solids of the composition.

16. A process of making paper or paperboard product wherein the composition of claim 1 is added to a pulp slurry in an amount ranging from 0.02 to 0.5 weight % actives based on the weight of the finished dry paper or paperboard.

17. The process of claim 16 wherein the amount ranges from 0.15 to 0.5%.

18. The process of claim 16 wherein the composition is added to the papermaking slurry wherein the papermaking slurry further comprises other papermaking additives selected from the group consisting of cationic, anionic, or amphoteric polyacrylamides, polyacrylic acid, copolymers of acrylamide and acrylic acid, carboxymethyl cellulose; crosslinked polyamidoamine, polydiallyldimethylammonium chloride, polyamine; polymeric aldehyde-functional compounds, glyoxalated polyacrylamides, aldehyde celluloses and aldehyde functional polysaccharides, polysaccharides, alum, clay, talc, titanium dioxide, calcium carbonate, pigments, dyes, rosin, sizing agents, and enzymes.

19. The process of claim 18 wherein the other papermaking additives is selected from the group consisting of anionic polyacrylamides, cationic polyacrylamides and mixtures thereof.

20. The process of claim 18 wherein the other papermaking additives comprise glyoxalated polyacrylamides.

21. A stable aqueous composition for papermaking comprising polyvinylamine and liquid cationic starch in a ratio of from 90 to 55 parts of polyvinylamine on an active basis to 10 to 45 parts of liquid cationic starch on an active basis, wherein the combined parts in active of liquid cationic starch and polyvinylamine comprise at least 40 weight % of the total solids of the composition wherein the Brookfield viscosity of the composition is in the range of 500 to 4000 cps using spindle #3 at 30 rpm and 25° C.

* * * * *